US007952474B2

(12) United States Patent
Kang et al.

(10) Patent No.: US 7,952,474 B2
(45) Date of Patent: May 31, 2011

(54) NUISANCE ALARM FILTER

(75) Inventors: Pengju Kang, Yorktown Heights, NY (US); Alan M. Finn, Hebron, CT (US); Robert N. Tomastik, Rocky Hill, CT (US); Thomas M. Gillis, Manchester, CT (US); Ziyou Xiong, West Hartford, CT (US); Lin Lin, Manchester, CT (US); Pei-Yuan Peng, Ellington, CT (US)

(73) Assignee: Chubb Protection Corporation, Farmington, CT (US)

( * ) Notice: Subject to any disclaimer, the term of this patent is extended or adjusted under 35 U.S.C. 154(b) by 651 days.

(21) Appl. No.: 11/885,814

(22) PCT Filed: Mar. 15, 2005

(86) PCT No.: PCT/US2005/008721

§ 371 (c)(1), (2), (4) Date: Apr. 10, 2008

(87) PCT Pub. No.: WO2006/101477

PCT Pub. Date: Sep. 28, 2006

(65) Prior Publication Data

US 2008/0272902 A1 Nov. 6, 2008

(51) Int. Cl.
*G08B 19/00* (2006.01)

(52) U.S. Cl. ..... 340/522; 340/521; 340/506; 340/507; 340/508; 340/552; 340/554; 340/561; 340/567

(58) Field of Classification Search ..... 340/522, 340/521, 506, 507, 508, 552, 554, 556, 561, 340/567

See application file for complete search history.

(56) References Cited

U.S. PATENT DOCUMENTS

| | | | | |
|---|---|---|---|---|
| 4,660,024 | A * | 4/1987 | McMaster | 340/522 |
| 4,697,172 | A | 9/1987 | Kimura | |
| 4,746,910 | A | 5/1988 | Pfister et al. | |
| 4,857,912 | A * | 8/1989 | Everett et al. | 340/508 |
| 5,793,286 | A | 8/1998 | Greene | |
| 5,977,871 | A | 11/1999 | Miller et al. | |
| 6,507,023 | B1 | 1/2003 | Parham et al. | |
| 6,597,288 | B2 | 7/2003 | Amano et al. | |
| 6,697,103 | B1 | 2/2004 | Fernandez et al. | |

FOREIGN PATENT DOCUMENTS

| | | |
|---|---|---|
| EP | 1079350 A1 | 2/2001 |
| GB | 2257598 A | 1/1993 |

OTHER PUBLICATIONS

International Search Report of the Patent Cooperation Treaty in Counterpart foreign Application No. PCT/US05/08721 filed Mar. 15, 2005.

Official Search Report and Written Opinion of the European Patent Office in counterpart foreign Application No. EP05725717, filed Mar. 15, 2005.

* cited by examiner

*Primary Examiner* — Tai T Nguyen

(74) *Attorney, Agent, or Firm* — Kinney & Lange, P.A.

(57) ABSTRACT

An alarm filter (22) for use in a security system (14) to reduce the occurrence of nuisance alarms receives sensor signals ($S_1$-$S_n$, $S_v$) from a plurality of sensors (18, 20) included in the security system (14). The alarm filter (22) produces an opinion output as a function of the sensor signals and selectively modifies the sensor signals as a function of the opinion output to produce verified sensor signals ($S_1'$-$S_n'$).

19 Claims, 4 Drawing Sheets

AND-MULTIPLICATION (^) OF TWO OPINIONS:
$O_1\{0.8\ 0.1\ 0.1\}$ ^ $O_2\{0.1\ 0.8\ 0.1\}$ = $O\{0.08\ 0.82\ 0.10\}$

OR-MULTIPLICATION (v) OF TWO OPINIONS:
$O_1\{0.8\ 0.1\ 0.1\}$ v $O_2\{0.1\ 0.8\ 0.1\}$ = $O\{0.08\ 0.08\ 0.10\}$

NUISANCE ALARM FILTER

BACKGROUND OF THE INVENTION

The present invention relates generally to alarm systems. More specifically, the present invention relates to alarm systems with enhanced performance to reduce nuisance alarms.

In conventional alarm systems, nuisance alarms (also referred to as false alarms) are a major problem that can lead to expensive and unnecessary dispatches of security personnel. Nuisance alarms can be triggered by a multitude of causes, including improper installation of sensors, environmental noise, and third party activities. For example, a passing motor vehicle may trigger a seismic sensor, movement of a small animal may trigger a motion sensor, or an air-conditioning system may trigger a passive infrared sensor.

Conventional alarm systems typically do not have on-site alarm verification capabilities, and thus nuisance alarms are sent to a remote monitoring center where an operator either ignores the alarm or dispatches security personnel to investigate the alarm. A monitoring center that monitors a large number of premises may be overwhelmed with alarm data, which reduces the ability of the operator to detect and allocate resources to genuine alarm events.

As such, there is a continuing need for alarm systems that reduce the occurrence of nuisance alarms.

BRIEF SUMMARY OF THE INVENTION

With the present invention, nuisance alarms are filtered out by selectively modifying sensor signals to produce verified sensor signals. The sensor signals are selectively modified as a function of an opinion output about the truth of an alarm event.

DETAILED DESCRIPTION

Figure 1:
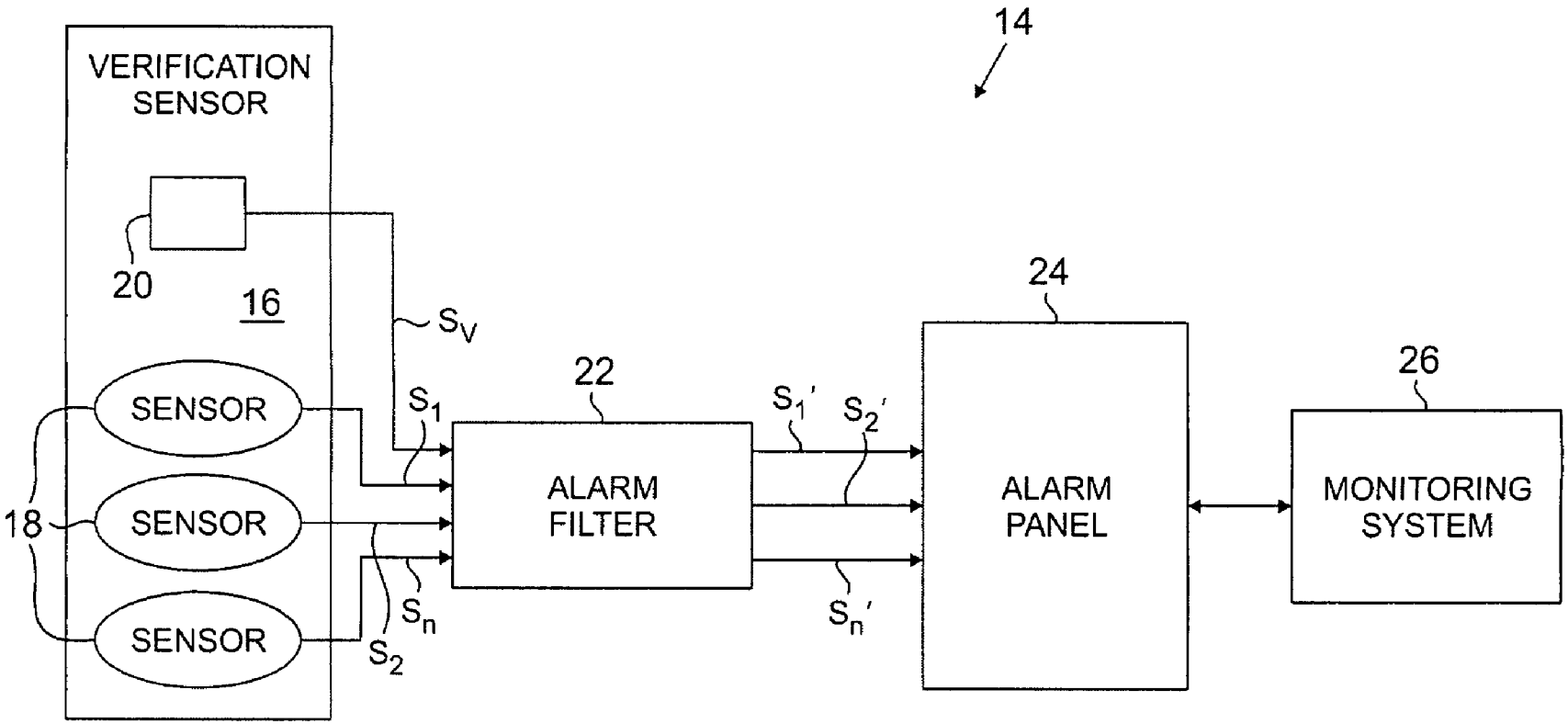
FIG. 1 is a block diagram of an embodiment of an alarm system of the present invention including a verification sensor and an alarm filter capable of producing verified sensor signals.

The present invention includes a filtering device for use with an alarm system to reduce the occurrence of nuisance alarms. FIG. 1 shows alarm system 14 of the present invention for monitoring environment 16. Alarm system 14 includes sensors 18, optional verification sensor 20, alarm filter 22, local alarm panel 24, and remote monitoring system 26.

Alarm filter 22 includes inputs for receiving signals from sensors 18 and verification sensor 20, and includes outputs for communicating with alarm panel 24. As shown in FIG. 1, sensors 18 and verification sensor 20 are coupled to communicate with alarm filter 22, which is in turn coupled to communicate with alarm panel 24. Sensors 18 monitor conditions associated with environment 16 and produce sensor signals $S_1$-$S_n$ (where n is the number of sensors 18) representative of the conditions, which are communicated to alarm filter 22. Similarly, verification sensor 20 also monitors conditions associated with environment 16 and communicates verification sensor signal(s) $S_v$ representative of the conditions to alarm filter 22. Alarm filter 22 filters out nuisance alarm events by selectively modifying sensor signals $S_1$-$S_n$ to produce verified sensor signals $S_1'$-$S_n'$, which are communicated to local alarm panel 24. If verified sensor signals $S_1'$-$S_n'$ indicate occurrence of an alarm event, this information is in turn communicated to remote monitoring system 26, which in most situations is a call center including a human operator. Thus, alarm filter 22 enables alarm system 14 to automatically verify alarms without dispatching security personnel to environment 16 or requiring security personnel to monitor video feeds of environment 16.

Alarm filter 22 generates verified sensor signals $S_1'$-$S_n'$ as a function of (1) sensor signals $S_1$-$S_n$ or (2) sensor signals $S_1$-$S_n$ and one or more verification signals $S_v$. In most embodiments, alarm filter 22 includes a data processor for executing an algorithm or series of algorithms to generate verified sensor signals $S_1'$-$S_n'$.

Alarm filter 22 may be added to previously installed alarm systems 14 to enhance performance of the existing system. In such retrofit applications, alarm filter 22 is installed between sensors 18 and alarm panel 24 and is invisible from the perspective of alarm panel 24 and remote monitoring system 26. In addition, one or more verification sensors 20 may be installed along with alarm filter 22. Alarm filter 22 can of course be incorporated in new alarm systems 14 as well.

Examples of sensors 18 for use in alarm system 14 include motion sensors such as, for example, microwave or passive infrared (PIR) motion sensors; seismic sensors; heat sensors; door contact sensors; proximity sensors; any other security sensor known in the art; and any of these in any number and combination. Examples of verification sensor 20 include visual sensors such as, for example, video cameras or any other type of sensor known in the art that uses a different sensing technology than the particular sensors 18 employed in a particular alarm application.

Sensors 18 and verification sensors 20 may communicate with alarm filter 22 via a wired communication link or a wireless communication link. In some embodiments, alarm system 14 includes a plurality of verification sensors 20. In other embodiments, alarm system 14 does not include a verification sensor 20.

Figure 2:
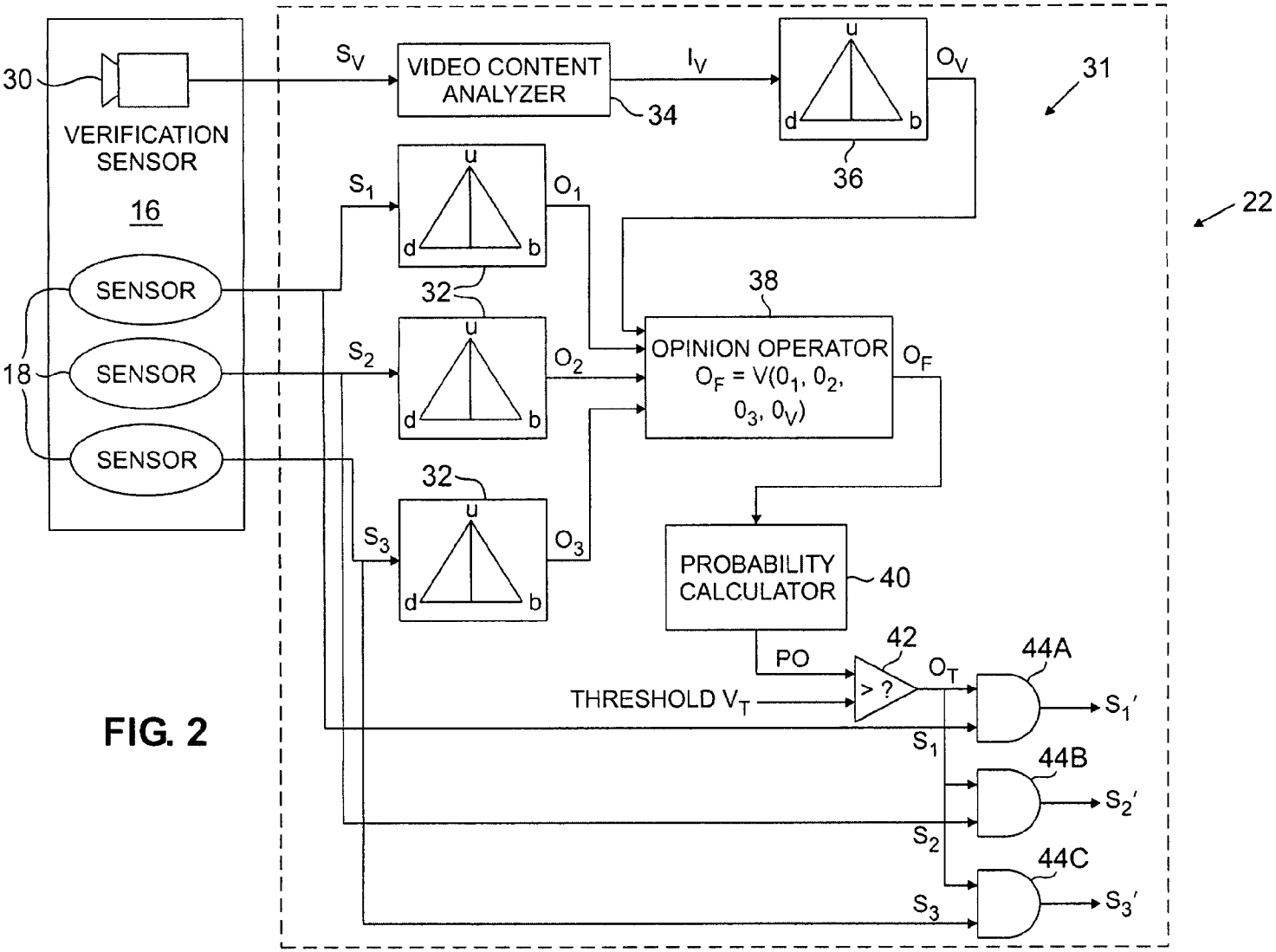
FIG. 2 is a block diagram of a sensor fusion architecture for use with the alarm filter of FIG. 1 for producing verified sensor signals.

FIG. 2 shows sensor fusion architecture 31, which represents one embodiment of internal logic for use in alarm filter 22 to verify the occurrence of an alarm event. As shown in FIG. 2, video sensor 30 is an example of verification sensor 20 of FIG. 1. Sensor fusion architecture 31 illustrates one method in which alarm filter 22 of FIG. 1 can use subjective logic to mimic human reasoning processes and selectively modify sensor signals $S_1$-$S_n$ to produce verified sensor signals $S_1'$-$S_n'$. Sensor fusion architecture 31 includes the following functional blocks: opinion processors 32, video content analyzer 34, opinion processor 36, opinion operator 38, probability calculator 40, threshold comparator 42, and AND-gates 44A-44C. In most embodiments, these functional blocks of sensor fusion architecture 31 are executed by one or more data processors included in alarm filter 22.

As shown in FIG. 2, sensor signals $S_1$-$S_3$ from sensors 18 and verification sensor signal $S_v$ from video sensor 30 are input to sensor fusion architecture 31. Pursuant to sensor standards in the alarm/security industry, sensor signals $S_1$-$S_3$ are binary sensor signals, whereby a "1" indicates detection of an alarm event and a "0" indicates non-detection of an alarm event. Each sensor signal $S_1$-$S_3$ is input to an opinion processor 32 to produce opinions $O_1$-$O_3$ as a function of each sensor signal $S_1$-$S_3$.

Verification sensor signal $S_v$, in the form of raw video data generated by video sensor 30, is input to video content analyzer 34, which extracts verification information $I_v$ from sensor signal $S_v$. Video content analyzer 34 may be included in alarm filter 22 or it may be external to alarm filter 22 and in communication with alarm filter 22. After being extracted, verification information $I_v$ is then input to opinion processor 36, which produces verification opinion $O_v$ as a function of verification information $I_v$. In some embodiments, verification opinion $O_v$ is computed as a function of verification information $I_v$ using non-linear functions, fuzzy logic, or artificial neural networks.

Opinions $O_1$-$O_3$ and $O_v$ each represent separate opinions about the truth (or believability) of an alarm event. Opinion $O_1$-$O_3$ and $O_v$ are input to opinion operator 38, which produces final opinion $O_F$ as a function of opinions $O_1$-$O_3$ and $O_v$. Probability calculator 40 then produces probability output PO as a function of final opinion $O_F$ and outputs probability output PO to threshold comparator 42. Probability output PO represents a belief, in the form of a probability, about the truth of the alarm event. Next, threshold comparator 42 compares a magnitude of probability output PO to a predetermined threshold value $V_T$ and outputs a binary threshold output $O_T$ to AND logic gates 44A-44C. If the magnitude of probability output PO exceeds threshold value $V_T$, threshold output $O_T$ is set to equal 1. If the magnitude of probability output PO does not exceed threshold value $V_T$, threshold output $O_T$ is set to equal 0.

As shown in FIG. 2, each of AND logic gates 44A-44C receives threshold output $O_T$ and one of sensor signals $S_1$-$S_3$ (in the form of either a 1 or a 0) and produces a verification signal $S_1'$-$S_3'$ as a function of the two inputs. If threshold output $O_T$ and the particular sensor signal $S_1$-$S_3$ are both 1, the respective AND logic gate 44A-44C outputs a 1. In all other circumstances, the respective AND logic gate 44A-44C outputs a 0. As such, alarm filter 22 filters out an alarm event detected by sensors 18 unless probability output PO is computed to exceed threshold value $V_T$. In most embodiments, threshold value $V_T$ is determined by a user of alarm filter 22, which allows the user to adjust threshold value $V_T$ to achieve a desired balance between filtering out nuisance alarms and preservation of genuine alarms.

As discussed above, probability output PO is a probability that an alarm event is a genuine (or non-nuisance) alarm event. In other embodiments, probability output PO is a probability that an alarm is a nuisance alarm and the operation of threshold comparator 42 is modified accordingly. In some embodiments, probability output PO includes a plurality of outputs (e.g., such as belief and uncertainty of an alarm event) that are compared to a plurality of threshold values $V_T$.

Examples of verification information $I_v$ for extraction by video content analyzer 34 include object nature (e.g., human versus nonhuman), number of objects, object size, object color, object position, object identity, speed and acceleration of movement, distance to a protection zone, object classification, and combinations of any of these. The verification information $I_v$ sought to be extracted from verification sensor signal $S_v$ can vary depending upon the desired alarm application. For example, if fire detection is required in a given application of alarm system 14, flicker frequency can be extracted (see Huang, Y., et al., *On-Line Flicker Measurement of Gaseous Flames by Image Processing and Spectral Analysis*, Measurement Science and Technology, v. 10, pp. 726-733, 1999). Similarly, if intrusion detection is required in a given application of alarm system 14, position and movement-related information can be extracted.

In some embodiments, verification sensor 20 of FIG. 1, (i.e., video sensor 30 in FIG. 2) may be a non-video verification sensor that is heterogeneous relative to sensors 18. In some of these embodiments, verification sensor 20 uses a different sensing technology to measure the same type of parameter as one or more of sensors 18. For example, sensors 18 may be PIR motion sensors while verification sensor 20 is a microwave-based motion sensor. Such sensor heterogeneity can reduce false alarms and enhance the detection of genuine alarm events.

In one embodiment of the present invention, opinions $O_1$-$O_3$, $O_v$, and $O_F$ are each expressed in terms of belief, disbelief, and uncertainty in the truth of an alarm event x. As used herein, a "true" alarm event is defined to be a genuine alarm event that is not a nuisance alarm event. The relationship between these variables can be expressed as follows:

$$b_x+d_x+u_x=1, \qquad \text{(Equation 1)}$$

where $b_x$ represents the belief in the truth of event x, $d_x$ represents the disbelief in the truth of event x, and $u_x$ represents the uncertainty in the truth of event x.

Fusion architecture 31 can assign values for $b_x$, $d_x$, and $u_x$ based upon, for example, empirical testing involving sensors 18, verification sensor 20, environment 16, or combinations of these. In addition, predetermined values for $b_x$, $d_x$, and $u_x$ for a given sensor 18 can be assigned based upon prior knowledge of that particular sensor's performance in environment 16 or based upon manufacturer's information relating to that particular type of sensor. For example, if a first type of sensor is known to be more susceptible to generating false alarms than a second type of sensor, the first type of sensor can be assigned a higher uncertainty $u_x$, a higher disbelief $d_x$, a lower belief $b_x$, or combinations of these.

Figure 3:
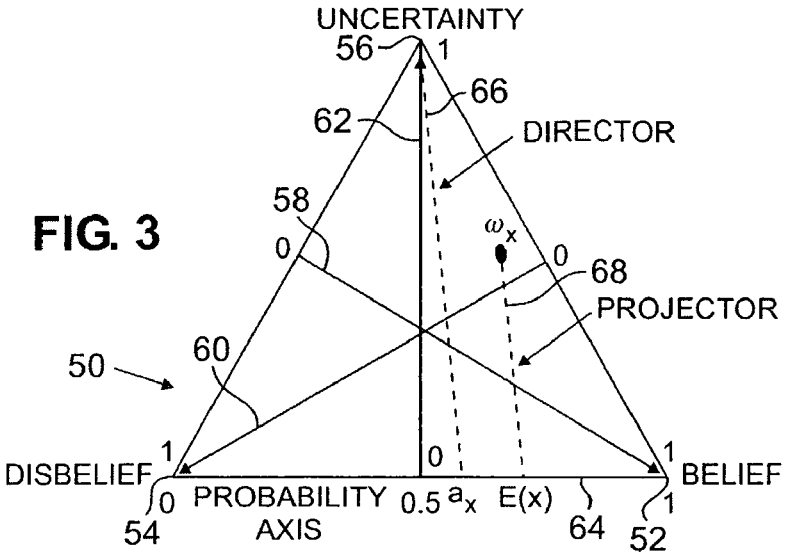
FIG. 3 is a graphical representation of a mathematical model for use with the sensor fusion architecture of FIG. 2.

FIG. 3 shows a graphical representation of a mathematical model for use with sensor fusion architecture of FIG. 2. FIG. 3 shows reference triangle 50 defined by Equation 1 and having a Barycentric coordinate framework. For further discussion of the Barycentric coordinate framework see Audun Josang, *A LOGIC FOR UNCERTAIN PROBABILITIES*, International Journal of Uncertainty, Fuzziness and Knowledge-Based Systems, Vol. 9, No. 3, June 2001. Reference triangle 50 includes vertex 52, vertex 54, vertex 56, belief axis 58, disbelief axis 60, uncertainty axis 62, probability axis 64, director 66, and projector 68. Different coordinate points ($b_x$, $d_x$, $u_x$) within reference triangle 50 represent different opinions $\omega_x$ about the truth of sensor state x (either 0 or 1). An example opinion point $\omega_x$ with coordinates of (0.4, 0.1, 0.5) is shown in FIG. 3. These coordinates are the orthogonal projections of point $\omega_x$ onto belief axis 58, disbelief axis 60, and uncertainty axis 62

Vertices 52-56 correspond, respectively, to states of 100% belief, 100% disbelief, and 100% uncertainty about sensor state x. As shown in FIG. 3, vertices 52-56 correspond to opinions $\omega_x$ of (1,0,0), (0,1,0), and (0,0,1), respectively. Opinions $\omega_x$ situated at either vertices 52 or 54 (i.e., when belief $b_x$ equals 1 or 0) are called absolute opinions and correspond to a 'TRUE' or 'FALSE' proposition in binary logic.

The mathematical model of FIG. 3 can be used to project opinions $\omega_x$ onto a traditional 1-dimensional probability space (i.e., probability axis 64). In doing so, the mathematical model of FIG. 3 reduces subjective opinion measures to traditional probabilities. The projection yields a probability expectation value $E(\omega_x)$, which is defined by the equation:

$$E(\omega_x)=a_x+u_xb_x, \quad \text{(Equation 2)}$$

where $a_x$ is a user-defined decision bias, $u_x$ is the uncertainty, and $b_x$ is the belief. Probability expectation value $E(\omega_x)$ and decision bias $a_x$ are both graphically represented as points on probability axis 64. Director 66 joins vertex 56 and decision bias $a_x$, which is inputted by a user of alarm filter 22 to bias opinions towards either belief or disbelief of alarms. As shown in FIG. 3, decision bias $a_x$ for exemplary point $\omega_x$ is set to equal 0.6. Projector 68 runs parallel to director 66 and passes through opinion $\omega_x$. The intersection of projector 68 and probability axis 64 defines the probability expectation value $E(\omega_x)$ for a given decision bias $a_x$.

Thus, as described above, Equation 2 provides a means for converting a subjective logic opinion including belief, disbelief, and uncertainty into a classical probability which can be used by threshold comparator 42 of FIG. 2 to assess whether an alarm should be filtered out as a nuisance alarm.

Figure 4A:
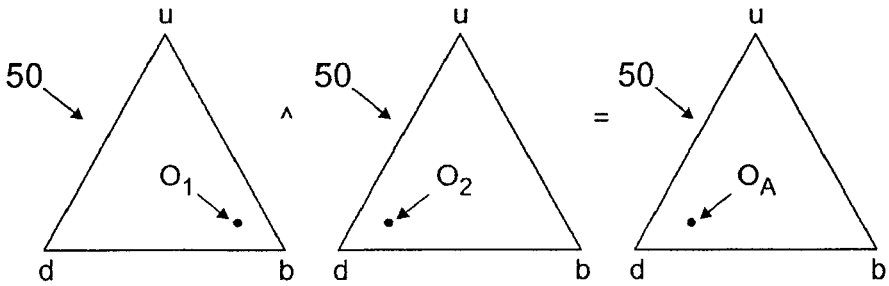
FIG. 4A is an example of a method for use with the sensor fusion architecture of FIG. 2 to aggregate opinions.
Figure 4B:
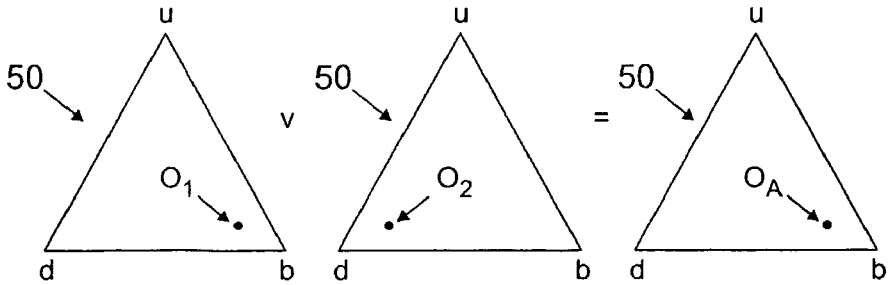
FIG. 4B is an example of another method for use with the sensor fusion architecture of FIG. 2 to aggregate opinions

FIGS. 4A and 4B each show a different method for aggregating multiple opinions to produce an aggregate (or fused) opinion. These methods can be used within fusion architecture 31 of FIG. 2. For example, the aggregation methods of FIGS. 4A and 4B may be used by opinion operator 38 in FIG. 2 to aggregate opinions $O_1$-$O_3$ and $O_v$, or a subset thereof.

FIG. 4A shows a multiplication (also referred to as an "and-multiplication") of two opinion measures ($O_1$ and $O_2$) plotted pursuant to the mathematical model of FIG. 3 and FIG. 4B shows a co-multiplication (also referred to as an "or-multiplication") of the same two opinion measures plotted pursuant to the mathematical model of FIG. 3. The multiplication method of FIG. 4A functions as an "and" operator while the co-multiplication method of FIG. 4B function as an "or" operator. As shown in FIG. 4A, the multiplication of $O_1$ (0.8,0.1,0.1) and $O_2$ (0.1,0.8,0.1) yields aggregate opinion $O_A$ (0.08,0.82,0.10), whereas, as shown, in FIG. 4B, the co-multiplication of $O_1$ (0.8,0.1,0.1) and $O_2$ (0.1,0.8,0.1) yields aggregate opinion $O_A$ (0.82,0.08,0.10).

The mathematical procedures for carrying out the above multiplication and co-multiplication methods are given below.

Opinion $Q_{1\hat{}2}$ ($b_{1\hat{}2}$,$d_{1\hat{}2}$,$a_{1\hat{}2}$) resulting from the multiplication of two opinions $O_1$ ($b_1$,$d_1$,$a_1$) and $O_2$ ($b_2$,$d_2$,$u_2$,$a_2$) corresponding to two different sensors is calculated as follows:

$$b_{1\hat{}2} = b_1b_2$$

$$d_{1\hat{}2} = d_1 + d_2 - d_1d_2$$

$$u_{1\hat{}2} = b_1u_2 + b_2u_1 + u_1u_2$$

$$a_{1\hat{}2} = \frac{u_1a_2b_1 + b_2u_2a_1 + a_1a_2u_1u_2}{u_{1\hat{}2}}$$

Opinion $Q_{1\vee2}$ ($b_{1\vee2}$,$d_{1\vee2}$,$u_{1\vee2}$,$a_{1\vee2}$) resulting from the co-multiplication of two opinions $O_1$ ($b_1$,$d_1$,$a_1$) and $O_2$ ($b_2$,$d_2$,$u_2$,$a_2$) corresponding to two different sensors is calculated as follows:

$$b_{1\vee2} = b_1 + b_2 - b_1b_2$$

$$d_{1\vee2} = d_1d_2$$

$$u_{1\vee2} = d_1u_2 + d_2u_1 + u_1u_2$$

-continued $$a_{1\vee2} = \frac{u_1a_1 + u_2a_2 - a_2b_1u_2 - a_1b_2u_1 - a_1a_2u_1u_2}{u_1 + u_2 - b_1u_2 - b_2u_1 - u_1u_2}$$

Other methods for aggregating opinion measures may be used to aggregate opinion measures of the present invention. Examples of these other methods include fusion operators such as counting, discounting, recommendation, consensus, and negation. Detailed mathematical procedures for these methods can be found in Audun Josang, *A LOGIC FOR UNCERTAIN PROBABILITIES*, International Journal of Uncertainty, Fuzziness and Knowledge-Based Systems, Vol. 9, No. 3, June 2001.

Tables 1-3 below provide an illustration of one embodiment of fusion architecture 31 of FIG. 2. The data in Tables 1-3 is generated by an embodiment of alarm system 14 of FIG. 1 monitoring environment 16, which includes an automated teller machine (ATM). Security system 14 includes video sensor 30 having onboard motion detection and three seismic sensors 18 for cooperative detection of attacks against the ATM. Seismic sensors 18 are located on three sides of the ATM. Video sensor 30 is located at a location of environment 16 with line of sight view of the ATM and surrounding portions of environment 16.

Opinion operator 38 of sensor fusion architecture 31 of FIG. 2 produces final opinion $O_F$ as a function of seismic opinions $O_1$-$O_3$ and verification opinion $O_v$ (based on video sensor 30) using a two step process. First, opinion operator 38 produces fused seismic opinion $O_{1\text{-}3}$ as a function of seismic opinions $O_1$-$O_3$ using the co-multiplication method of FIG. 4B. Then, opinion operator 38 produces final opinion $O_F$ as a function of fused seismic opinion $O_1$-$O_3$ and verification opinion $O_v$ using the multiplication method of FIG. 4A. In the example of Tables 1-3, for an alarm signal to be sent to alarm panel 24 by alarm filter 22, threshold comparator 42 of sensor fusion architecture 31 requires that final opinion $O_F$ include a belief $b_x$ greater than 0.5 and an uncertainty $u_x$ less than 0.3. Each of opinions $O_1$-$O_3$, $O_v$, and $O_F$ of Tables 1-3 were computed using a decision bias $a_x$ of 0.5.

TABLE 1

| | $O_1$ | $O_2$ | $O_3$ | $O_{1\text{-}3}$ | $O_V$ | $O_F$ |
|---|---|---|---|---|---|---|
| $b_x$ | 0.0 | 0.0 | 0.0 | 0.0 | 0.0 | 0.0 |
| $d_x$ | 0.8 | 0.8 | 0.8 | 0.512 | 0.8 | 0.9 |
| $u_x$ | 0.2 | 0.2 | 0.2 | 0.488 | 0.2 | 0.1 |

Table 1 illustrates a situation in which none of the seismic sensors have been triggered, which yields a final opinion $O_F$ of (0.0,0.9,0.1) and a probability expectation of attack of 0.0271. Since final opinion $O_F$ has a belief $b_x$ value of 0.0, which does not exceed the threshold belief $b_x$ value of 0.5, alarm filter 22 does not send an alarm to alarm panel 24.

TABLE 2

| | $O_1$ | $O_2$ | $O_3$ | $O_{1\text{-}3}$ | $O_V$ | $O_F$ |
|---|---|---|---|---|---|---|
| $b_x$ | 0.05 | 0.8 | 0.05 | 0.8195 | 0.85 | 0.70 |
| $d_x$ | 0.85 | 0.1 | 0.85 | 0.0722 | 0.05 | 0.12 |
| $u_x$ | 0.1 | 0.1 | 0.1 | 0.10825 | 0.1 | 0.18 |

Table 2 illustrates a situation in which the ATM is attacked, causing video sensor 30 and one of seismic sensors 18 to detect the attack. As a result, opinion operator 38 produces a final opinion $O_F$ of (0.70,0.12,0.18), which corresponds to a probability expectation of attack of 0.8. Since final opinion $O_F$ has a belief $b_x$ value of 0.70 (which exceeds the threshold belief $b_x$ value of 0.5) and an uncertainty $u_x$ value of 0.18 opinion $O_F$ (which falls below the threshold uncertainty $u_x$ value of 0.3), alarm filter 22 sends a positive alarm to alarm panel 24.

TABLE 3

| | $O_1$ | $O_2$ | $O_3$ | $O_{1-3}$ | $O_V$ | $O_F$ |
|---|---|---|---|---|---|---|
| $b_x$ | 0.8 | 0.8 | 0.8 | 0.992 | 0.85 | 0.84 |
| $d_x$ | 0.1 | 0.1 | 0.1 | 0.001 | 0.05 | 0.05 |
| $u_x$ | 0.1 | 0.1 | 0.1 | 0.007 | 0.1 | 0.11 |

Table 3 illustrates a situation in which the ATM is again attacked, causing video sensor 30 and all of seismic sensors 18 to detect the attack. As a result, opinion operator 38 produces a final opinion $O_F$ of (0.84,0.05,0.11), which corresponds to a probability expectation of attack of 0.9. Since final opinion $O_F$ has a belief $b_x$ value of 0.84 (which exceeds the threshold belief $b_x$, value of 0.5) and an uncertainty $u_x$ value of 0.11 opinion $O_F$ (which falls below the threshold uncertainty $u_x$ value of 0.3), alarm filter 22 sends a positive alarm to alarm panel 24.

Figure 5:
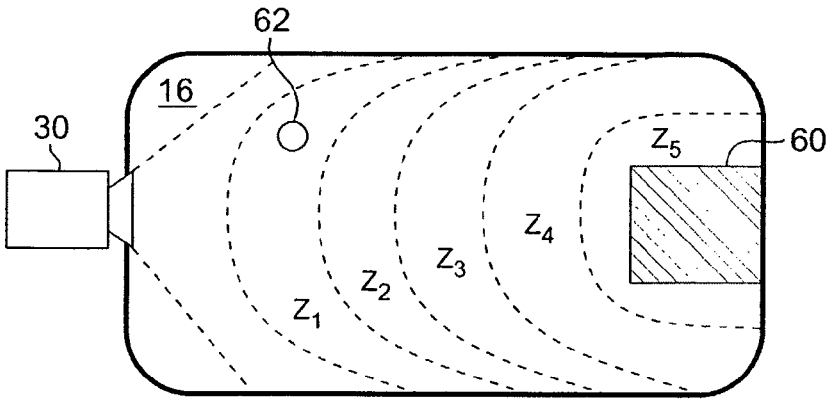
FIG. 5 illustrates a method for use with the sensor fusion architecture of FIG. 2 to produce verification opinions as a function of a verification sensor signal.

FIG. 5 illustrates one method for producing verification opinion $O_v$ of FIG. 2 as a function of verification information $I_v$. FIG. 5 shows video sensor 30 of FIG. 2 monitoring environment 16, which, as shown in FIG. 5, includes safe 60. In this embodiment, video sensor 30 is used to provide verification opinion $O_v$ relating to detection of intrusion object 62 in proximity to safe 60. Verification opinion $O_v$ includes belief $b_x$, disbelief $d_x$, and uncertainty $u_x$ of attack, which are defined as a function of the distance between intrusion object 62 and safe 60 using pixel positions of intrusion object 62 in the image plane of the scene. Depending on the distance between intrusion object 62 and safe 60, uncertainty $u_x$ and belief $b_x$ of attack vary between 0 and 1. If video sensor 30 is connected to a video content analyzer 34 capable of object classification, then the object classification may be used to reduce uncertainty $u_x$ and increase belief $b_x$.

As shown in FIG. 5, the portion of environment 16 visible to visual sensor 30 is divided into five different zones $Z_1$-$Z_5$, which are each assigned a different predetermined verification opinion $O_v$. For example, in one embodiment, the different verification opinions $O_v$ for zones $Z_1$-$Z_5$ are (0.4, 0.5, 0.1), (0.5, 0.4, 0.1), (0.6, 0.3, 0.1), (0.7, 0.2, 0.1), and (0.8, 0.1, 0.1), respectively. As intrusion object 62 moves from zone $Z_1$ into a zone closer to safe 60, belief $b_x$ in an attack increases and disbelief $d_x$ in the attack decreases.

Some embodiments of alarm filter 22 of the present invention can verify an alarm as being true, even when video sensor 30 of FIG. 2 fails to detect the alarm event. In addition, other embodiments of alarm filter 22 can verify an alarm event as being true even when alarm system 14 does not include any verification sensor 20.

Figure 6:
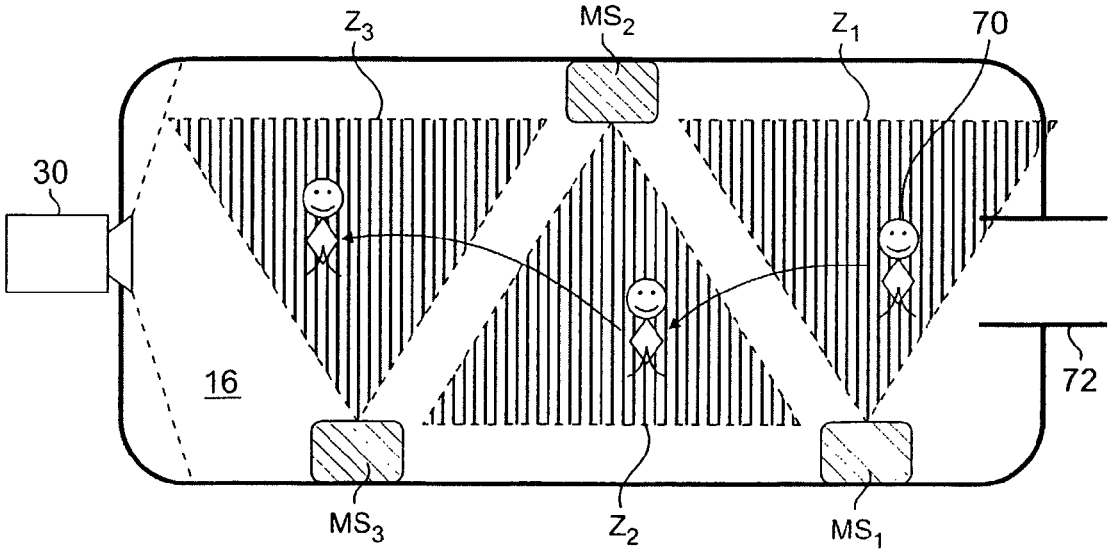
FIG. 6 shows an embodiment of the alarm system of FIG. 1 including three motion sensors for detecting an intruder.

For example, FIG. 6 shows one embodiment of alarm system 14 of FIG. 1 that includes three motion sensors $MS_1$, $MS_2$, and $MS_3$ and video sensor 30 for detecting human intruder 70 in environment 16. As shown in FIG. 6, motion sensors $MS_1$-$MS_3$ are installed in a non-overlapping spatial order and each sense a different zone $Z_1$-$Z_3$. When human intruder 70 enters zone $Z_1$ through access 72, intruder 70 triggers motion sensor $MS_1$ which produces a detection signal. In one embodiment, upon alarm filter 22 receiving the detection signal from $MS_1$, video sensor 30 is directed to detect and track intruder 70. Verification opinion $O_v$ (relating to video sensor 30) and opinions $O_1$-$O_3$ (relating to motion sensors $MS_1$-$MS_3$) are then compared to assess the nature of the intrusion alarm event. If video sensor 30 and motion sensor $MS_1$ both result in positive opinions that the intrusion is a genuine human intrusion, then an alarm message is sent from alarm filter 22 to alarm panel 24.

If video sensor 30 fails to detect and track intruder 70, (meaning that opinion $O_v$ indicates a negative opinion about the intrusion), opinions $O_1$-$O_3$ corresponding to motion sensors $MS_1$-$MS_3$ are fused to verify the intrusion. Since human intruder 70 cannot trigger all of the non-overlapping motions sensors simultaneously, a delay may be inserted in sensor fusion architecture 31 of FIG. 2 so that, for example, opinion $O_1$ of motion sensor $MS_1$ taken at a first time can be compared with opinion $O_2$ of motion sensor $MS_2$ taken after passage of a delay time. The delay time can be set according to the physical distance within environment 16 between motion sensors $MS_1$ and $MS_2$. After passage of the delay time, opinion $O_2$ can be compared to opinion $O_1$ using, for example, the multiplication operator of FIG. 4A. If both of opinions $O_1$ and $O_2$ indicate a positive opinion about intrusion, a corresponding alarm is sent to alarm panel 24. In some embodiments, if an alarm is not received from motion sensor $MS_3$ within an additional delay time, the alarms from motion sensors $MS_1$ and $MS_2$ are filtered out by alarm filter 22. Also, in some embodiments, if two or more non-overlapping sensors are fired almost at the same time, then these alarms are deemed to be false and filtered out.

The above procedure also applies to situations where alarm system 14 does not include an optional verification sensor 20. In these situations, alarm filter 22 only considers data from sensors 18 (e.g., motion sensors $MS_1$-$MS_3$ in FIG. 6).

In addition, to provide additional detection and verification capabilities, alarm system 14 of FIG. 6 can be equipped with additional motion sensors that have overlapping zones of coverage with motion sensors $MS_1$-$MS_3$. In such situations, multiple motion sensors for the same zone should fire simultaneously in response to an intruder. The resulting opinions from the multiple sensors, taken at the same time, can then be compared using the multiplication operator of FIG. 4A.

In some embodiments of the present invention, opinion operator 38 of sensor fusion architecture 31 uses a voting scheme to produce final opinion $O_F$ in the form of a voted opinion. The voted opinion is the consensus of two or more opinions and reflects all opinions from the different sensors 18 and optional verification sensor(s) 20, if included. For example, if two motion sensors have detected movement of intruding objects, opinion processors 32 form two independent opinions about the likelihood of one particular event, such as a break-in. Depending upon the degree of overlap between the coverage of the various sensors, a delay time(s) may be inserted into sensor fusion architecture 31 so that opinions based on sensor signals generated at different time intervals are used to generate the voted opinion.

For a two-sensor scenario, voting is accomplished according to the following procedure. The opinion given to the first sensor is expressed as opinion $O_1$ having coordinates ($b_1$, $d_1$, $u_1$, $a_1$), and the opinion given to the second sensor is expressed as opinion $O_2$ having coordinates ($b_2$, $d_2$, $u_2$, $a_2$), where $b_1$ and $b_2$ are belief, $d_1$ and $d_2$ are disbelief, $u_1$ and $u_2$ are uncertainty, and $a_1$ and $a_2$ are decision bias. Opinions $O_1$ and $O_2$ are assigned according to the individual threat detection capabilities of the corresponding sensor, which can be obtained, for example, via lab testing or historic data. Opinion operator 38 produces voted opinion $O_{1\otimes 2}$ having coordinates ($b_{1\otimes 2}$, $d_{1\otimes 2}$, $u_{1\otimes 2}$, $a_{1\otimes 2}$) as a function of opinion $O_1$ and opinion $O_2$. Voted opinion $O_{1\otimes 2}$ is produced using the following voting operator (assuming overlap between the coverage of the first and second sensors):

When $k=u_1+u_2-u_1u_2\neq 0$ $$b_{1\otimes 2}=\frac{b_1u_2+b_2u_1}{k}$$

$$d_{1\otimes 2}=\frac{d_1u_2+d_2u_1}{k}$$

$$u_{1\otimes 2}=\frac{u_1u_2}{k}$$

$$a_{1\otimes 2}=\frac{u_1a_2+u_2a_1+(a_1+a_2)u_1u_2}{u_1+u_2-2u_1u_2}$$

When $k=u_1+u_2-u_1u_2=0$ $$b_{1\otimes 2}=\frac{b_1+b_2}{2}$$

$$d_{1\otimes 2}=\frac{d_1+d_2}{2}$$

$$u_{1\otimes 2}=0$$

$$a_{1\otimes 2}=\frac{a_2+a_1}{2}$$

The voting operator ($\otimes$) can accept multiple opinions corresponding to sensors of same type and/or multiple opinions corresponding to different types of sensors. The number of sensors installed in a given zone of a protected area in a security facility is determined by the vulnerability of the physical site. Regardless of the number of sensors installed, the voting scheme remains the same.

For a multiple-sensor scenario with redundant sensor coverage, the voting is carried out according to the following procedure:

$$O_{1\otimes 2,\ldots,\otimes n}=O_1\otimes O_2\otimes\ldots\otimes O_i\otimes\ldots\otimes O_n$$

where $O_{1\otimes 2,\ldots,\otimes n}$ is the voted opinion, $O_i$ is the opinion of the $i^{th}$ sensor, n is the total number of sensors installed in a zone of protection, and $\otimes$ represents the mathematical consensus (voting) procedure.

In some embodiments, if the sensors are arranged to cover multiple zones with minimal or no sensor coverage overlap, then time delays are be incorporated into the voting scheme. Each time delay can be determined, for example, by the typical speed an intruding object should exhibit in the protected area and the spatial distances between sensors. In this case, the voted opinion $O_{1\otimes 2,\ldots,\otimes n}$ is expressed as:

$$O_{1\otimes 2,\ldots,\otimes n}=O_1(T_1)\otimes O_2(T_2)\otimes\ldots\otimes O_i(T_i)\otimes\ldots\otimes O_n(T_n)$$

where $T_1,\ldots,T_n$ are the time windows specified within which the opinions of the sensors are evaluated. The sequence number 1, 2 . . . n in this case does not correspond to the actual number of the physical sensors, but rather the logic sequence number of the sensors fired within a specific time period. If a sensor fires outside the time window, then its opinion is not counted in the opinion operator.

In some embodiments of the voting operator, opinions corresponding to a plurality of non-video sensors 18 can be combined using, for example, the multiplication operator of FIG. 4A and then voted against the opinion of one or more video sensors (or other verification sensor(s) 20) using the voting operator described above.

As described above with respect to exemplary embodiments, the present invention provides a means for verifying sensor signals from an alarm system to filter out nuisance alarms. In one embodiment, an alarm filter applies subjective logic to form and compare opinions based on data received from each sensor. Based on this comparison, the alarm filter verifies whether sensor data indicating occurrence of an alarm event is sufficiently believable. If the sensor data is not determined to be sufficiently believable, the alarm filter selectively modifies the sensor data to filter out the alarm. If the sensor data is determined to be sufficiently believable, then the alarm filter communicates the sensor data to a local alarm panel.

Although the present invention has been described with reference to preferred embodiments, workers skilled in the art will recognize that changes may be made in form and detail without departing from the spirit and scope of the invention.

The invention claimed is:

1. An alarm filter for filtering out nuisance alarms in a security system including a plurality of sensors to monitor an environment and detect alarm events, the alarm filter comprising:

sensor inputs for receiving sensor signals from the plurality of sensors;

means for selectively modifying the sensor signals to produce verified sensor signals, wherein the means for selectively modifying the sensor signals produces opinions about the sensor signals as a function of the sensor signals and produces the verified sensor signals as a function of the sensor signals and the opinions; and sensor outputs for communicating the verified sensor signals to an alarm panel.

2. The alarm filter of claim 1, and further comprising:

a verification input for receiving verification sensor signals from a verification sensor, wherein the sensors signals are selectively modified as a function of the verification sensor signals and the sensor signals to produce the verified sensor signals.

3. The alarm filter of claim 1, wherein the means for selectively modifying the sensor signals to produce verified sensor signals comprises a data processor in communication with the sensor inputs and outputs.

4. The alarm filter of claim 1, wherein the means for selectively modifying the sensor signals to produce the verified sensor signals comprises a data processor using an algorithm to generate the verified sensor signals.

5. The alarm filter of claim 4, wherein the algorithm forms the opinions about the sensor signals and selectively modifies the sensor signals as a function of the opinions to produce the verified sensor signals.

6. An alarm system for monitoring an environment to detect alarm events and communicate alarms based on the alarm events to a remote monitoring center, the alarm system comprising:

a plurality of sensors for monitoring conditions associated with the environment and producing sensor signals in response to alarm events;

a verification sensor for monitoring conditions associated with the environment and producing verification sensor signals representative of the conditions; and an alarm filter in communication with the plurality of sensors to produce an opinion output as a function of the sensor signals and the verification sensor signals, and produces verified sensor signals as a function of the sensor signals and the opinion output.

7. The alarm system of claims 6, and further comprising:

an alarm panel in communication with the alarm filter.

8. The alarm system of claim 6, wherein the verification sensor comprises a video sensor.

9. The alarm system of claim 8, wherein the alarm system includes a video content analyzer for receiving raw sensor data from the video sensor and generating the verification sensor signals as a function of the raw sensor data.

10. The alarm system of claim 6, wherein the verification sensor senses a different parameter than the plurality of sensors to monitor conditions associated with the environment.

11. A method for reducing the occurrence of nuisance alarms generated by an alarm system including a plurality of sensors for monitoring conditions associated with an environment, the method comprising:

receiving sensor signals from the plurality of sensors representing conditions associated with the environment;

processing the sensor signals to produce an opinion output as a function of the sensor signals, wherein the opinion output represents a relative indication about a truth of an alarm event; and selectively modifying the sensor signals as a function of the opinion output to produce verified sensor signals.

12. The method of claim 11, wherein the opinion output is generated as a function of a plurality of intermediate opinions.

13. The method of claim 11, wherein the opinion output comprises a belief indication about the truth of an alarm event.

14. The method of claim 11, wherein the opinion output comprises a disbelief indication about the truth of an alarm event.

15. The method of claim 11, wherein the opinion output comprises an uncertainty indication about the truth of an alarm event.

16. The method of claim 11, and further comprising:

comparing a magnitude of the opinion output to a threshold value, wherein the sensor signals are selectively modified as a function of the comparison.

17. The method of claim 11, and further comprising:

communicating the verified sensor signals to an alarm panel.

18. The method of claim 11, wherein the plurality of sensor signals include at least one verification sensor signal generated by a verification sensor that uses a different sensing technology than other sensors of the plurality of sensors.

19. An alarm system for monitoring an environment to detect alarm events and communicate alarms based on the alarm events to a remote monitoring center, the alarm system comprising:

a plurality of sensors for monitoring conditions associated with the environment and producing sensor signals in response to alarm events;

a verification sensor for monitoring conditions associated with the environment and producing verification sensor signals representative of the conditions, wherein the verification sensor comprises a video sensor;

a video content analyzer for receiving raw sensor data from the video sensor and generating the verification sensor signals as a function of the raw sensor data; and an alarm filter in communication with the plurality of sensors to produce an opinion output as a function of the sensor signals and the verification sensor signals.

* * * * *

UNITED STATES PATENT AND TRADEMARK OFFICE

CERTIFICATE OF CORRECTION

PATENT NO. : 7,952,474 B2
APPLICATION NO. : 11/885814
DATED : May 31, 2011
INVENTOR(S) : Kang et al.

It is certified that error appears in the above-identified patent and that said Letters Patent is hereby corrected as shown below:

Col. 5, Line 44
Insert --u1^2,-- after d1^2,

Col. 5, Line 45
Insert --u1-- after d1,

Signed and Sealed this
Sixth Day of December, 2011

David J. Kappos

David J. Kappos
*Director of the United States Patent and Trademark Office*